United States Patent [19]
Arai et al.
[11] 4,400,224
[45] Aug. 23, 1983

[54] METHOD FOR FORMING A CARBIDE LAYER ON THE SURFACE OF A FERROUS ALLOY ARTICLE OR A CEMENTED CARBIDE ARTICLE

[75] Inventors: Tohru Arai, Toyoake; Hironori Fujita, Aichi; Yasuo Takada, Nagoya, all of Japan

[73] Assignee: Kabushiki Kaisha Toyota Chuo Kenkyusho, Aichi, Japan

[21] Appl. No.: 365,022

[22] Filed: Apr. 2, 1982

[30] Foreign Application Priority Data

Apr. 20, 1981 [JP] Japan ..... 56-59486

[51] Int. Cl.[3] ..... C21D 1/48

[52] U.S. Cl. ..... 148/15; 148/6.11; 148/28; 427/399; 427/431; 252/71

[58] Field of Search ..... 148/15, 15.5, 20, 28, 148/6.11; 252/71; 427/399, 431

[56] References Cited

U.S. PATENT DOCUMENTS

| | | | |
|---|---|---|---|
| 2,757,107 | 7/1956 | Heger et al. | 148/15 |
| 3,390,021 | 6/1968 | Michael | 148/15 |
| 3,719,518 | 3/1973 | Komatsu et al. | 148/15.5 |
| 3,885,059 | 5/1975 | Komatsu et al. | 427/431 |
| 3,912,827 | 10/1975 | Komatsu et al. | 427/431 |
| 3,922,405 | 11/1975 | Komatsu et al. | 148/15.5 |
| 3,930,060 | 12/1975 | Komatsu et al. | 427/431 |
| 4,158,578 | 6/1979 | Komatsu et al. | 427/431 |
| 4,202,705 | 5/1980 | Komatsu et al. | 427/431 |
| 4,230,751 | 10/1980 | Komatsu et al. | 427/431 |
| 4,250,208 | 2/1981 | Arai | 427/431 |

*Primary Examiner*—John P. Sheehan
*Attorney, Agent, or Firm*—Berman, Aisenberg & Platt

[57] ABSTRACT

A method for forming a carbide layer on the surface of a carbon-containing ferrous alloy article or a cemented carbide article in a molten treating bath. The bath is prepared by introducing 5 to 20% by weight of alumina into molten boric acid or borate bath and a carbide-forming element dissolved therein. By employing the treating bath of this invention, the life of the bath can be remarkably improved, and no sintered substance of undissolved carbide-forming element is produced in the treating bath. Further, it is possible to reduce markedly the corrosion of the article and of the vessel holding the bath.

20 Claims, No Drawings

METHOD FOR FORMING A CARBIDE LAYER ON THE SURFACE OF A FERROUS ALLOY ARTICLE OR A CEMENTED CARBIDE ARTICLE

BACKGROUND OF THE INVENTION

1. Field of the Invention

The present invention relates to a method for forming a carbide layer on the surface of a ferrous alloy article or a cemented carbide article (by immersing the aforesaid article in a treating bath comprising molten boric acid or borate, and a carbide-forming element dissolved therein) and to a treating material for forming the treating bath.

2. Description of the Prior Art

The following surface-treating method is known. A carbon-containing ferrous alloy article or a cemented carbide article is immersed in a treating bath composed of molten boric acid or borate and a carbide-forming element, such as a Va-Group element of the Periodic Table [e.g. vanadium (V), niobium (Nb) and tantalum (Ta)], chromium or the like, dissolved therein, thus forming a carbide layer on the surface of the article. This surface-treating method can be easily and inexpensively carried out in an atmosphere. Moreover, the formed carbide layer is remarkably improved in wear resistance and seizure resistance. This surface-treating method is thus widely applicable to metal dies, jigs and the like.

In the aforesaid surface-treating method, it is advantageous to maintain the treating bath at a high temperature (without melting the article) to minimize the time required for forming a carbide layer of desired thickness. When this treating method is applied to a steel article, the temperature of the treating bath is advantageously maintained at a quenching temperature for the steel, and hardening is carried out at the same time as the surface treatment of the steel. For example, for a high-speed steel a treating bath having a temperature within a range of from 1150° C. to 1300° C. is employed.

However, the following problems arise when such a high-temperature treating bath is employed.

The first problem involves lowering the life of the treating bath. Namely, if the aforesaid prior art surface treating method is carried out in an atmosphere, the treating ability of the bath shows a tendency to be lowered gradually from the upper portion of the bath. While, if the bath temperature is no more than about 950° C., the extent of lowering such treating ability is not so troublesome in practical use. However, when the bath temperature is 1050° C. or higher, the treating ability of the bath is rapidly lowered toward the lower portion of the bath.

The second problem concerns undissolved powder of a metal, such as ferrovanadium (Fe-V) or the like, added to the treating bath as a carbide-forming element; it is deposited on the bottom of the vessel holding the bath and is sintered thereon. This sintered substance adheres intensely to the vessel and reduces the effective bath volume of the vessel. Moreover, the sintered substance also intensely adheres to the surface of the treated article and decreases the smoothness of the surface of the article. Further, the carbide layer cannot be formed on the surface of an article to which the sintered substance adheres.

The third problem is partial corrosion of the vessel and of the article. Even when a heat resistant casting alloy is used for the vessel, corrosion of the vessel is liable to occur, particularly at a portion thereof in contact with the boundary of the bath which is exposed to the atmosphere. The corrosion reaction proceeds as an exponential function of the bath temperature. If the bath temperature becomes high (about 1200° C.), such corrosion becomes more pronounced. Furthermore, if the bath temperature is high, the article, a part of which is immersed in the bath, significantly corrodes at a portion thereof which is in contact with the boundary of the bath.

In addition, there is a further problem, i.e. the oxidation of the carbide layer, when the treated article is removed from the bath. It occurs at the time of removing the article from the bath. But this problem is not as serious as the aforesaid problems. Namely, the article to be treated is immersed in the treating bath to form a carbide layer on the surface thereof and, thereafter, the article is removed from the treating bath. At this time, the substance of the bath adheres to the surface of the treated carbide layer due to the viscosity of the bath. Because of the aforesaid adhesion of such a substance, the oxidation of the carbide layer, which occurs immediately after the treated article has been removed from the bath, can be prevented. The substance of the bath adhering to the surface of the carbide layer can be removed thereafter by hot water or the like. In the meantime, if the temperature of the treating bath is high, the viscosity thereof is materially decreased so that the substance of the bath only adheres to the surface of the treated article with an extremely thin layer. Therefore, the oxidation of the carbide layer is not substantially prevented.

SUMMARY OF THE INVENTION

The inventors have conducted many experiments and investigations in order to solve the foregoing disadvantages and problems.

An object of the present invention is to provide an improved method for forming a carbide layer on the surface of a carbon-containing ferrous alloy article or a cemented carbide article in a molten treating bath for the purpose of overcoming previously-noted defects at high temperatures.

An additional object of the present invention is to provide a treating material for preparing a molten treating bath which has a remarkably improved life, even at high temperatures.

Another object of the present invention is to provide a treating material for preparing a molten treating bath in which no sintered substance of undissolved carbide-forming element is produced.

A further object of the present invention is to provide a method for forming a carbide layer while preventing corrosion of the article to be treated or of the vessel holding the bath.

A still further object of the present invention is to provide a method for forming a carbide layer having oxidation resistance.

Another object of the present invention is to provide a method for forming a carbide layer with improved workability at high temperatures.

A further object of the present invention is to provide a method for forming a carbide layer of desired quality at an economically low cost.

A method for forming a carbide layer on the surface of a carbon-containing ferrous alloy article or a cemented carbide article according to the present invention comprises the steps of:

preparing a treating bath comprising molten boric acid or borate, a carbide-forming element dissolved therein and 5 to 20% by weight of alumina, based on the whole weight of the bath;

keeping the treating bath at a temperature within the range from 1050° C. to a temperature lower than the melting point of the article to be treated;

immersing the article into the molten treating bath;

maintaining the article in the molten treating bath to form a carbide layer of the carbide-forming element on the surface of the article; and removing the article from the molten treating bath.

DETAILED DESCRIPTION

The molten treating bath consists essentially of boric acid or borate, a carbide-forming element and alumina. The carbide forming element, such as a Va-group element or chromium, is in metal form, alloy form or oxide form. The Va-group element or chromium in alloy form, e.g., ferro-niobium (Fe-Nb), ferro-tantalum (Fe-Ta), ferro-vanadium (Fe-V) or ferro-chromium (Fe-Cr) has at least 20% by weight and preferably at least 40% by weight of niobium, tantalum, vanadium or chromium, respectively. When the carbide-forming element in oxide form is dissolved in the molten treating bath, a boron-supplying material (wherein the boron is not bound to oxygen) should be further incorporated. The boron-supplying material reduces the oxide, facilitates dissolving the carbide-forming element in the bath and enables the bath to form a carbide layer on the surface of the article immersed therein.

It is preferable that an amount of alumina to be added to the treating bath is from 5 to 20% by weight. If the amount of alumina is less than 5% by weight, the aforesaid effects cannot be sufficiently expected. Whereas, if the amount of alumina is more than 20% by weight, the formed carbide layer does not reach the required thickness for its practical use.

Alumina is added to the treating bath in the form of powder and therefore, the smaller the particle size of the powder is, the sooner the aforesaid effects (due to alumina) can be shown. Further, because of the added alumina, the viscosity of the bath is not materially lowered even when a high temperature treating bath is employed. Therefore, when the treated article is removed from the bath, the substance of the bath adheres to the surface of the treated article to cover the surface thereof. As a result, oxidation of the carbide layer formed on the treated article can be prevented.

The ferrous alloy article or the cemented carbide article to be treated must contain at least 0.1% by weight of carbon. The carbon in the article enters into the composition of the carbide layer formed during the treatment. It is presumed that carbon in the article diffuses to the surface thereof and reacts with the carbide-forming element in the molten treating bath to form a carbide layer on the surface of the article. A higher carbon content in the article is preferred for forming the carbide layer. A ferrous alloy article or a cemented carbide article containing less than 0.1% by weight of carbon may not be provided with a uniform and thick carbide layer by the subject treatment.

The present invention is illustrated by the following examples, which are not in any way intended to limit the scope of the invention.

EXAMPLE 1

(A) A molten bath of borax (the depth being 200 mm) at 1200° C., in which Fe-V powder (−100 mesh*, including 50% by weight of V) is dissolved as a carbide-forming element, was prepared. The amount of the Fe-V powder was 20% of the whole weight of the treating bath. (Hereinafter, % means % by weight.) Then, a piece of tool steel (Japanese Industrial Standard SKH 9) having a diameter of 7 mm and length of 200 mm was immersed in the aforesaid treating bath for 10 minutes in the depth direction of the bath to form a vanadium carbide layer on the surface of the steel. Such a surface treatment was repeated at intervals of an hour.

*mesh: based on the Tyler Standard Screen-Scale Sieve Standards

In accordance with a lapse of time, the carbide-forming ability of the treating bath in the upper part thereof was lowered, and then it became impossible to form the carbide layer on the surface of each steel piece. The life of the bath, or the time at which no carbide layer was formed on one half of the article, was five hours. (Hereinafter, the aforesaid time means the life of the bath.)

(B) On the other hand, another treating bath was prepared by adding 10% of alumina powder ($Al_2O_3$), having a purity of 99.4% and a particle diameter of from 35 to 50μ, to the previously-prepared treating bath; the same experiment as described above was carried out employing the thus-prepared treating bath. As a result, the life of the bath was for 18 hours. The life of the bath was greatly improved.

In the experiment of (A), a particle of sintered substance was produced at the bottom of a pot holding the treating bath. In the experiment of (B), however, such sintered substance was not produced, and there was no adhesion of the sintered substance to the surface of the treated article.

Moreover, the corrosion of the treated article due to the treating bath was 0.5 mm in its depth at a portion thereof in contact with the boundary of the bath in the experiment of (A). In the experiment of (B), on the other hand, it was 0.05 mm. The depth of corrosion in the pot at a portion thereof in contact with the boundary of the bath was also remarkably reduced as compared with the experiment of (A).

The thickness of the vanadium carbide layer formed on the article was 6 to 7μ in the experiment of (A), whereas in the experiment of (B) employing the treating bath to which alumina was added, the thickness thereof was 5 to 6μ. This thickness is somewhat less than that of the experiment of (A) but there is no trouble in the practical use thereof.

Example 2

As a treating bath, a molten borax bath (to which 20% of Fe-V powder of under −100 mesh and 5% of alumina having a particle diameter of 35 to 50μ and a purity of 99.4%, respectively, are added) was employed, wherein the temperature of the treating bath was 1200° C. The same experiment as in Example 1 was carried out. As a result, the life of the bath was for 7 hours and the corrosion of the treated article was 0.15 mm in its depth. Also, the sintered substance at the bottom of the pot was not produced.

Thus, the treating bath containing 5% of alumina has the effect of solving the aforesaid problems, if it is compared with a treating bath containing no alumina. However, the aforesaid effect of alumina in this treating bath (containing 5% of alumina) is worse than that containing 10% of alumina. The amount of alumina to be added is, preferably, 5% or more.

Example 3

The molten borax bath having a carbide-forming element dissolved therein and to which 20% of alumina was added was prepared. The temperature of the bath was 1200° C. And then the same experiment as in Example 1 was carried out, employing the thus prepared treating bath. As a result, even after lapse of 30 hours, a carbide layer was able to be formed on the article. The treating bath had not yet reached the end of the life of the bath.

However, the thickness of the formed carbide layer was thin, i.e. about 1μ. Because of such a thin layer the use of the product thus treated is limited. Therefore, it is preferable that the amount of alumina added to the treating bath is 20% or less.

In the meanwhile, the bath containing 20% of alumina is effective for not only a treating bath for forming the carbide layer but also, particularly, a quenching bath for high speed steel having a carbide layer formed thereon.

Example 4

In place of Fe-V powder employed in Example 1, 10% of $V_2O_5$ and $B_4C$ in their total amount was added to the molten bath at the same time. And then, the same experiment as in Example 1 (except for the treating temperature of 1150° C.) was carried out employing the thus prepared treating bath. As a result, even after the lapse of 21 hours, the life of the bath was able to be extended further. The depth of corrosion in the treated article was 0.05 mm.

Example 5

(A) In place of Fe-V powder employed in Example 1-(A), ferro-niobium (Fe-Nb) powder (−100 mesh, including about 50% by weight of Nb) was employed, and a molten borax bath of 1200° C. having Fe-Nb powder dissolved therein was prepared. The same experiment as in Example 1 was carried out to form a niobium carbide layer on the treated article. As a result, the life of the bath was for 12 hours, and a particle of sintered substance of 2 to 3 mm in diameter was produced at the bottom of the pot.

(B) The same experiment as in Example 1 was carried out by employing a molten borax bath of 1200° C., wherein 20% of the aforesaid Fe-Nb powder was dissolved and 10% of alumina powder was also added. As a result, the life of the bath was for 28 hours, and particles of sintered substance were not produced at the bottom of the pot.

On the other hand, 245 g of borax, 70 g of Fe-Nb and 35 g of alumina [this composition being the same as in the initial bath composition in this Example 5-(B)] were added to the bath which had already reached the life of the bath. As a result, a niobium carbide layer was formed on the treated article in the same range as in the initial case.

Example 6

The same experiment as in Example 1 was carried out by employing a molten borax bath of 1200° C. having a carbide-forming element dissolved therein; as the carbide forming element, 20% of chromium powder was employed and 10% of alumina powder was also added. As a result, a chromium carbide layer was formed on the treated article. The life of the bath was for 20 hours and, at this time, particles of sintered substance were not also produced at the bottom of the pot.

On the other hand, a treating bath not containing alumina was employed to form the chromium carbide layer. As a result, the life of the bath was for 4 hours and particles of sintered substance were produced at the bottom of the pot.

Example 7

The treating baths in Examples 1-(A) and 1-(B) were, respectively, employed to form a carbide layer on a cemented carbide article. (WC+12% of Co).

In the treating bath of Example 1-(A) not containing alumina, the life of the bath was for 5 hours and particles of the sintered substance were produced at the bottom of the pot.

In the treating bath of Example 1-(B) containing alumina, on the other hand, the life of the bath was for 18 hours, and particles of sintered substance were not produced at the bottom of the pot.

As is apparent from the aforesaid Examples, in the surface treatment for forming a carbide layer on the surface of a carbon-containing ferrous alloy article or cemented carbide article, which is characterized by employing a high temperature treating bath comprising molten boric acid or borate and a carbide-forming element dissolved therein and by immersing the aforesaid article to be treated in the molten treating bath, the life of the bath is greatly improved by adding a suitable amount of alumina to the treating bath. Further, it is possible to prevent particles of sintered substance of undissolved powder of the carbide-forming element from being produced. Furthermore, corrosion of the treated article and of the vessel holding the bath can be reduced. Moreover, if alumina is added, the viscosity of the bath is increased so that the substance of the bath adheres to the surface of the treated article in a relatively thick layer to cover the surface thereof, even if the treated article is removed from a treating bath of high temperature. Therefore, the oxidation of the formed carbide layer also can be prevented. Even if $Fe_2O_3$, $Cr_2O_3$, $V_2O_5$, $Nb_2O_5$, $Ta_2O_5$ and the like are contained in the treating bath, the aforesaid effects of alumina are not reduced as far as the amount thereof are not so much.

In the aforesaid Examples, the treating bath was held in a pot having a small volume to carry out the surface treatment.

On the other hand, if a large amount of the treating bath is held in a pot having a large volume to carry out the surface treatment, the life of the bath can be extended. However, in case that a treating bath of a high temperature of about 1200° C. is employed, a carbide layer having a sufficient thickness in its practical use can be formed, if only the article to be treated is immersed in the treating bath for about 5 to 30 minutes. Therefore, it is not necessary to use such a large pot as mentioned above. Thus, the improvement of the life of the bath due to the aforesaid sizing effect is limited and, therefore, in the case of a high temperature treating bath, the bath itself has to maintain the treating ability for a long time. To improve such a treating ability of the bath itself has been demanded heretofore. The present invention meets this demand and contributes to improve the workability and the property of the product and also to make the cost down.

The invention and its advantages are readily understood and appreciated from the preceding description. Various changes may be made in the compositions, treating baths and coated articles without departing from the spirit and scope of the invention.

What is claimed is:

1. A method for forming a carbide layer on the surface of a carbon-containing ferrous alloy article or a cemented carbide article, comprising the steps of:

(a) preparing a treating bath comprising molten boric acid or borate, a carbide-forming element dissolved therein and 5 to 20% by weight, based on the whole weight of the bath, of alumina;

(b) keeping said treating bath at a temperature within the range from 1050° C. to a temperature lower than the melting point of the article to be treated;

(c) immersing the article into the molten treating bath;

(d) maintaining said article in said molten treating bath to form a carbide layer of said carbide-forming element on the surface of said article; and (e) removing said article from said molten treating bath.

2. A method according to claim 1, wherein said alumina is in powder form.

3. A method according to claim 1, wherein said carbide-forming element is a member selected from the group consisting of a Va group element of the Periodic Table and chromium.

4. A method according to claim 3, wherein said carbide-forming element is in alloy form.

5. A method according to claim 3, wherein said carbide-forming element is in oxide form and said treating bath further comprises a boron-supplying material wherein boron is not bound to oxygen.

6. A method according to claim 4, wherein said borate is borax and said carbide-forming element in alloy form is Fe-V.

7. A method according to claim 4, wherein said borate is borax and said carbide-forming element in alloy form is Fe-Nb.

8. A method according to claim 3, wherein said borate is borax and said carbide-forming element is chromium.

9. A method according to claim 5, wherein said borate is borax, said carbide forming element in oxide form is $V_2O_5$ and said boron-supplying material is $B_4C$.

10. A method according to any one of claims 6 to 9, wherein the amount of said alumina is 10% by weight of the whole weight of said treating bath.

11. A treating material for forming a carbide layer on the surface of a carbon-containing ferrous alloy article or a cemented carbide article which is composed of boric acid or a borate, a carbide-forming element and from 5 to 20% by weight, based on the whole weight of the treating material, of alumina.

12. A treating material according to claim 11, wherein said alumina is in powder form.

13. A treating material according to claim 11, wherein said carbide-forming element is a member selected from the group consisting of a Va group element of the Periodic Table and chromium.

14. A treating material according to claim 13, wherein said carbide-forming element is an alloy.

15. A treating material according to claim 13, wherein said carbide-forming element is in oxide form and said treating material further comprises a boron-supplying material wherein boron is not bound to oxygen.

16. A treating material according to claim 14, wherein said borate is borax and said carbide-forming element in alloy form is Fe-V.

17. A treating material according to claim 14, wherein said borate is borax and said carbide-forming element in alloy form is Fe-Nb.

18. A treating material according to claim 13, wherein said borate is borax and said carbide forming element is chromium.

19. A treating material according to claim 15, wherein said borate is borax, said carbide forming element in oxide form is $V_2O_5$ and said boron-supplying material is $B_4C$.

20. A treating material according to any one of claims 16 to 19, wherein the amount of said alumina is 10% by weight based on the whole weight of said treating material.

* * * * *